United States Patent [19]

Kooi et al.

[11] Patent Number: 4,887,448

[45] Date of Patent: Dec. 19, 1989

[54] KNOCKOUT PIN APPARATUS

[75] Inventors: J. Peter E. Kooi; James W. Myers, Jr., both of Carrollton, Ky.

[73] Assignee: Teledyne Industries Inc., Chester, Pa.

[21] Appl. No.: 209,554

[22] Filed: Jun. 21, 1988

[51] Int. Cl.[4] ..... B21J 13/14

[52] U.S. Cl. ..... 72/344; 72/427

[58] Field of Search ..... 267/130, 140.2; 72/344, 72/345, 465, 427

[56] References Cited

U.S. PATENT DOCUMENTS

| | | | |
|---|---|---|---|
| 175,653 | 4/1876 | Bliss | 72/345 |
| 2,585,047 | 2/1952 | Scibelli | 72/427 |

*Primary Examiner*—Lowell A. Larson

*Attorney, Agent, or Firm*—Wood, Herron & Evans

[57] ABSTRACT

An improved spring-biased knockout pin apparatus for use in an impact extrusion press provides for initial pin position adjustment and subsequent spring preload adjustment without affecting the preset pin position. Methods are included.

5 Claims, 3 Drawing Sheets

KNOCKOUT PIN APPARATUS

This invention relates to impact extrusion presses and more particularly to an improved knockout pin apparatus and set-up methods useful in such presses.

While such presses can be adapted to many uses, one particular application is in the formation of collapsible aluminum tubes for holding and dispensing compounds such as pharmaceuticals. Typically, such tubes have an externally threaded neck extending from a tapered shoulder area with a generally cylindrical tube extending rearwardly from the shoulder area to a flattened, sealed end. The tubes are either open-ended, with an unobstructed passageway through the neck, or are closed-ended. In the closed-end tube, an integral membrane or diaphragm extends across the neck passageway, closing off the tube. It must be pierced before components therein can be dispensed.

Prior to filling, such tubes are first typically formed in impact extrusion press. The open rear ends of the tubes are then trimmed and threads are rolled onto the neck. Thereafter, the tubes are subjected to further processing such as annealing, interior lining, cring, decorating, printing, capping, torquing, and in some cases, applying a band of glue at the open end. The tubes are then typically shipped to a pharmaceutical company where they are sterilized, filled and sealed.

In the formation of a collapsible, closed end aluminum tube in an impact extrusion press, a slug of appropriate size is positioned between a forming mandrel and a die. The slug is pressed into the die against a knockout pin which is adjustably spring biased toward the mandrel and is disposed in a predetermined initial position within the die. As the forming mandrel continues forwardly, it forces the aluminum material of the slug into the die to form the neck, top shoulder portions and diaphragm of the tube. The excess aluminum is extruded backwardly along the mandrel to form thin cylindrical tube walls. During this operation, the knockout pin is pushed rearwardly against its spring bias. The diaphragm thickness is determined as a function of the spring bias selected. Thereafter, the mandrel is withdrawn and the knockout pin moves forwardly, ejecting the tube from the die.

Two of the critical factors involved in impact extrusion of collapsible aluminum tubes in such a process are: (a) initial knockout pin position, and (b) magnitude of bias applied to the knockout pin by the associated spring. If the initial pin position is retarded from its preferred position (i.e. withdrawn from the die), subsequent tube formation causes the internal surface of the tube neck to develop a cold weld. This cold weld advances rearwardly of the tube mouth proportionately to the withdrawn pin position, and constitutes interior surface deformities in the tube neck. Such deformity results in neck weakness which is further acted upon by forces imparted to the tube neck during the subsequent rolling of external threads on the neck. These forces can cause the weakened or deformed aluminum surface material to form slivers in the internal surface of the neck. These slivers can come off and be delivered with material from within the tube. Cold welds are thus a significant disadvantage and cause rejection of the tube.

On the other hand, if the initial pin position is advanced forwardly into the die from the preferred initial position, the tube membrane or diaphragm can be pierced or "blanked out". Tests have shown that the proper initial positioning of the pin should be within ±0.010" of a preferred setting in order to prevent either a deleterious cold weld or such blanking out. Initial pin positioning is thus extremely important in such impact extrusion process.

In prior known knockout systems, both the initial pin position and the spring bias is adjustable. The difficulty with the prior known devices, however, is that these two adjustments are interdependent. Specifically, any change in the pin position also results in a change in the effective or dynamic spring pressure upon press operation. At the same time, changes in the spring pressure result in a change in static or initial pin position.

In the first instance, effective spring pressure changes since any adjustment of the initial pin position results in a change in the length of pin stroke. That is to say that if the initial pin position is advanced, the final actual pin stroke will be lengthened, and when the initial pin position is retarded, the stroke will be decreased. Due to the physical laws respecting springs, such as the heavy coil springs used in such systems, the spring pressure varies with this stroke change. For example, if the initial pin position is advanced, the overall pin stroke, upon extrusion, will be longer and the resulting spring bias will increase. If the initial pin position is retarded, the overall pin stroke, and effective pressure, will decrease.

In the second instance, the static or initial pin position will change if the spring bias is adjusted. This is due to the construction and operation of the known spring adjustment mechanisms, which cause movement of the knockout pin when the spring is compressed or relieved in adjustment.

Where the initial pin position of a known system is to be adjusted, then a corresponding change must also be made in the spring pressure adjustment to insure the same desired pressure for the new stroke length. To complicate matters, such spring adjustment causes a further initial pin position change and further pin position adjustment is necessary to get back to the desired initial position Such back and forth adjustments are carried out until finally a compromise pin position and spring preload is reached. This interdependency between the two adjustments renders the proper fine adjustment of the overall system rather difficult, and usually a matter of time-consuming trial and error for even skilled operators.

Accordingly, it is one objective of this invention to provide an improved knockout pin apparatus facilitating easier and more precise final set up in an impact extrusion press using a knockout pin.

It is a further objective of the invention to provide a knockout pin apparatus wherein the initial pin position can be selected and thereafter a pressure adjustment made without a resulting additional change in pin position.

A further objective of the invention has been to provide an improved knockout pin apparatus wherein pin position is independent of spring preload.

To these ends, a preferred embodiment of the invention contemplates an improved knockout pin apparatus wherein the initial pin position can be selected and the spring bias thereafter adjusted without any resulting change in the initial pin position.

In such a preferred embodiment, a knockout pin is carried on a central push rod mounted at its rearward end in a rotatable housing which also carries a heavy coil spring. A tension sleeve in the housing slidably receives the push rod and has a radial flange supported on a shoulder at the forward end of the housing. A portion of the push rod interacts with this flange so that rearward motion of the knockout pin and push rod interacts with the forward end of the spring to compress it. A high tension adjustment nut is screwed into the housing at its rear end to engage the rear end of the spring and to compress the spring against the housing shoulder to thereby adjust its preload. This adjustment compresses or relieves the spring against, or in relation to, the forward shoulder of the housing. Since this shoulder is fixed, the compression adjustment of the spring will not result in any relative motion of the forward end of the spring with respect to the housing, nor any relative motion of the push rod and knockout pin. Both rod and pin will remain unchanged in position with respect to the housing. The spring preload is thus adjustable independently of initial pin position.

This is to be contrasted to prior known system wherein the spring preload is adjusted by varying the position of the forward end of the spring with respect to the housing, and thus always resulting in a change in initial push rod and knockout pin position.

Since the forward end of the spring in the preferred embodiment of the invention, together with the tension sleeve, is always located at a set position with respect to the housing, adjustment of the housing to vary the initial position of the knockout pin in the forward die does not change the preload on the spring. The effective bias, however, is changed in view of any change to pin position since the pin stroke is lengthened or shortened as mentioned above. In this embodiment, however, once initial pin position is set, the spring preload is easily thereafter adjusted to a desired condition independently of pin position, and no further adjustments to either pin position or preload are required.

This invention has several advantages over the known prior devices. In particular, the exact pin position can be set in the die without reference to the condition of the spring system in the adjusting housing. Thereafter, the appropriate spring bias can be set in the adjusting body independently of the pin position and without affecting the pin position.

The ability to position the pin, and then adjust the correct spring pressure without affecting the pin position, permits the equipment to be easily set up and run without time consuming multiple dependent adjustments as required by the prior devices. An operator is able to work with only one variable at a time, and thus may more easily and quickly produce the exact parameters required for the particular forming operation. Thus the attainment of two critical factors in the forming operation, namely the pin position and the spring pressure, is greatly facilitated.

These and other objects and advantages will be readily appreciated from the following detailed description of a preferred embodiment of the invention and from the drawings in which.

PRIOR ART SYSTEM

Figure 1:
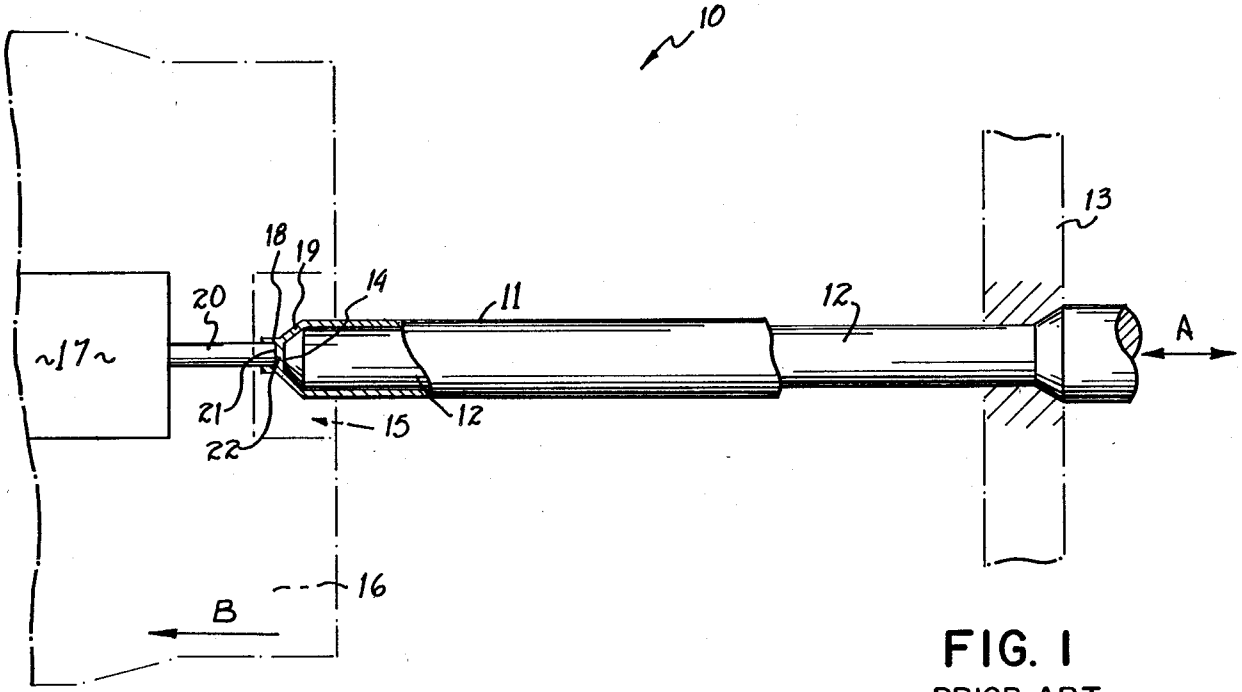
FIG. 1 PRIOR ART
FIG. 1 is a diagrammatic view of a prior art impact extrusion press of the type upon which the present invention is an improvement.

Turning now to the drawings, there is first illustrated in FIG. 1 thereof, a diagrammatic representation of a prior art horizontal impact extrusion press 10 for forming closed-end collapsible aluminum tubes 11. Such a known press generally includes a reciprocal mandrel 12 mounted on a machine frame 13 for reciprocation as indicated by arrow A.

The mandrel 12 is provided with a forward end 14 which can be pushed with great force into a die apparatus 15, mounted on a frame 16 of the press 10. The details of the die are not shown.

Figure 2:
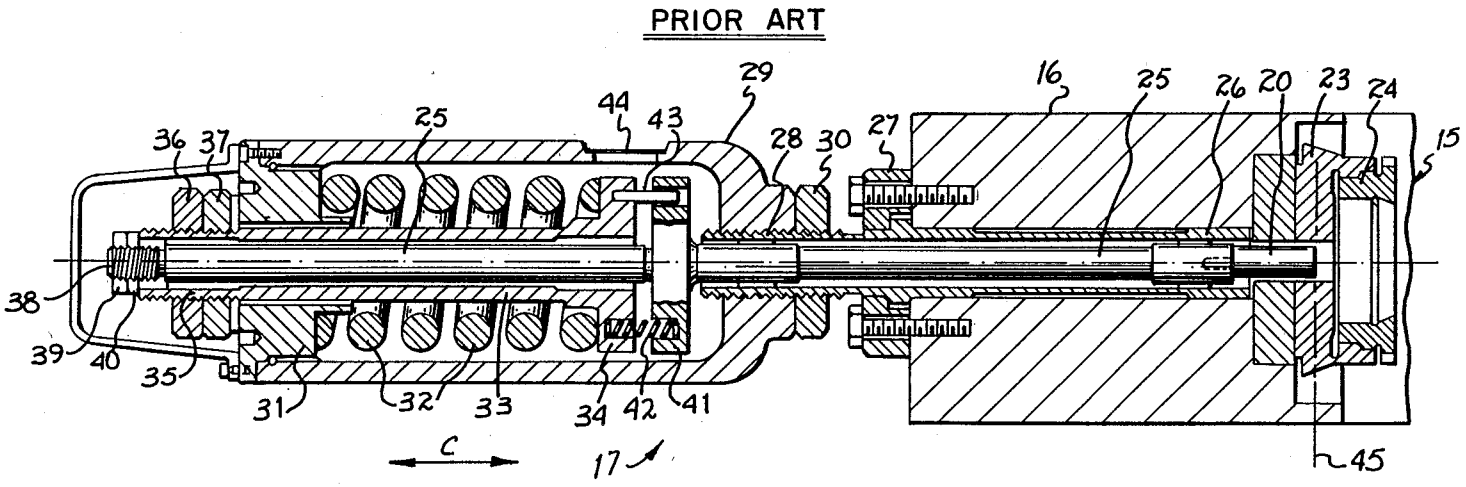
FIG. 2 is a cross-sectional view of certain details of a prior art knockout system as in FIG. 1, and omitting portions of the tube forming die for clarity.
Figure 3:
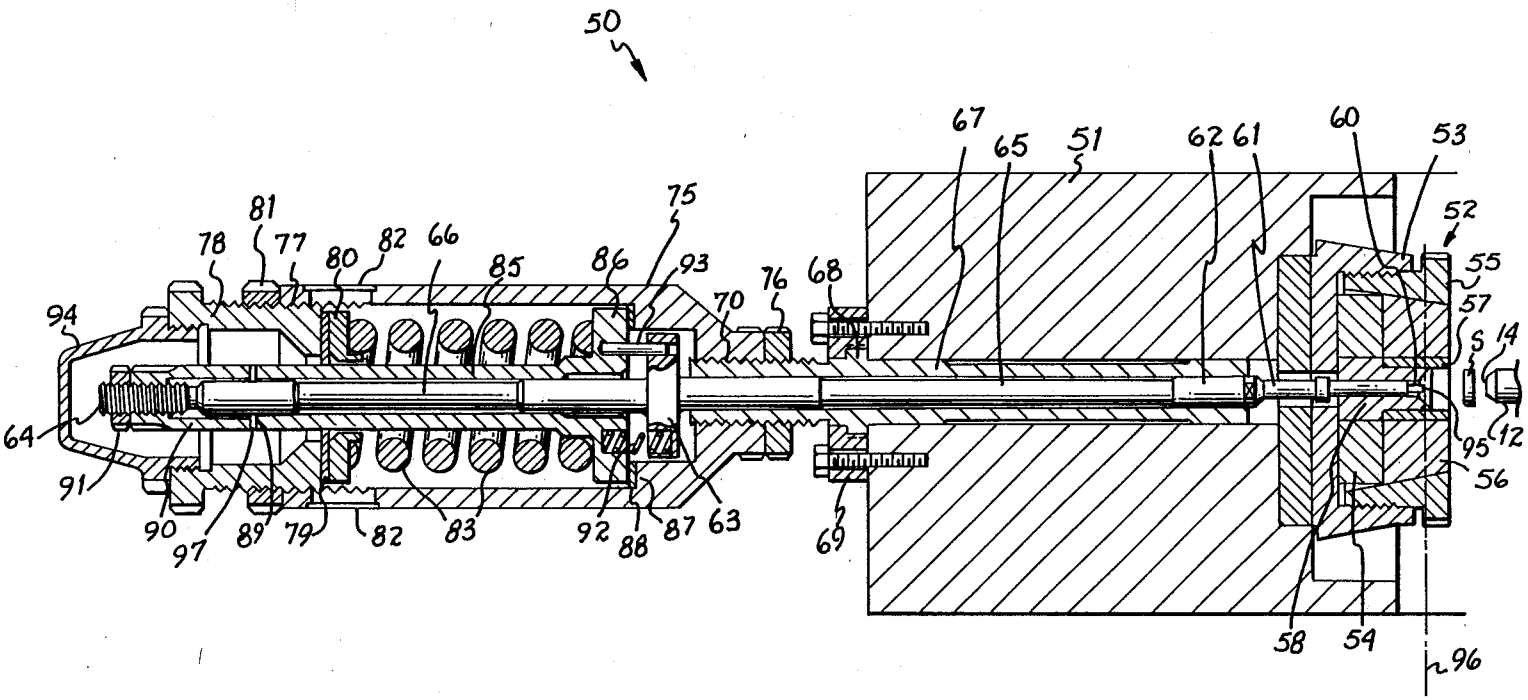
FIG. 3 is a cross-sectional view of the improved knockout pin apparatus of the invention.

A prior art, spring-biased, reciprocal knockout pin system 17, the details of which are best seen in FIG. 2, is also mounted on frame 16. This system 17 will be explained in more detail to facilitate understanding of the invention of this application which is depicted in FIG. 3, and later described.

It will be appreciated that the mandrel 12 (FIG. 1) is extended to the left (as viewed in that figure) into the die apparatus 15. When a slug of appropriate aluminum material is first positioned at the mouth of die apparatus 15, forward end 14 of the mandrel 12 pushes the slug into the die apparatus 15 and begins to form it within the die into the general tube configuration shown in FIG. 1. The aluminum material is formed into an integral neck 18 and tapered shoulder area 19. As the slug material is pushed by the mandrel into the die, it extrudes around the mandrel and then rearwardly to form rearwardly extending cylindrical tube walls. At the same time the aluminum material is pushed into the die by the mandrel 12, the material engages a knockout pin 20 about which the neck 18 of the tube is formed. Continued pressurization by the mandrel causes the knockout pin 20 to be moved to the left, in the direction of arrow B as shown in FIG. 1, for a predetermined distance against a spring bias provided in knockout pin system 17. The neck of the tube 18 is formed about the knockout pin while the end face of the knockout pin defines the forward face 21 of a membrane or diaphragm 22 extending across the neck of the tube. The thickness of the diaphragm 22 is determined by the magnitude of the spring pressure biasing the knockout pin 20 toward the right as viewed in FIG. 1. The thickness is preferably about 0.003", for example, in one application.

More details of the prior art knockout pin system are shown in FIG. 2, which depicts more details of several of the features of FIG. 1, including more detail of the die structure 15. It will be appreciated that the die structure 15 includes further die components, comprising the die holder 23 and the die clamping nut 24. The actual die components forming the shape of the forward end of the tube are omitted for purposes of clarity.

The knockout pin 20 is engaged with a central push rod mounted within a first sleeve 26 which is clamped to the frame 16 by means of a bolted on flange 27. A rearward end 28 of the sleeve is externally threaded.

A rotatable housing 29 is mounted on sleeve end 28 and secured thereto by means of a housing lock nut 30. It will thus be appreciated that on loosening of the lock nut 30, the entire housing 29 can be rotated on the sleeve nd 28. The housing is thus moved in either direction indicated by the arrow C, depending on the direction of rotation.

A spring seat 31 is secured to the housing 29, and a coil spring 32 has its rear end in engagement therewith. A sleeve 33 is mounted within the housing and within the seat 31. Sleeve 33 has a radially disposed flange 34 serving as a forward spring seat. The rear end 35 of the sleeve 33 is externally threaded and provided with a lock nut 36 and an adjusting nut 37. When a lock nut 36 is loosened, the adjusting nut 37 can be turned to reciprocate the sleeve 33 within the housing. When the nut 36 is turned in one direction, the sleeve is retracted to the left as viewed in FIG. 2, thereby compressing the spring 32, for example. This preload adjustment is thus accomplished by moving the forward end of the spring with respect to the housing. This typically carries the push rod 25 in an axial direction as well.

The central push rod 25 extends through the housing 29 and has a rear threaded end 38 on which are mounted a lock nut 39 and an adjusting nut 40. Rotation of the adjusting nut 40 on the threaded end 38 serves to move the radial forward flange 41, which is an integral part of the central push rod 25, to the left or to the right with respect to the flange 34 and sleeve 33. Rearward movement of the flange 41 with respect to the flange 34, for example, closes the gap between the two flanges.

The springs 42, of which there are three, are axially directed and radially spaced around the shaft of push rod 25 and serve to bias this flange forwardly. This construction is used to facilitate pushing the formed tube forwardly and out of the die structure 15 after it has been formed. In many instances, the flange 41 is adjusted so that it abuts the flange 34, thereby negating the function of the springs 42. Three axially directed, radially spaced pins, one of which is shown at 43, serve to slidably mount the two flanges 34 and 41 with respect to each other and to prevent them from rotating with respect to each other.

A window 44 is provided in the housing 29. A scale can be mounted in the window for viewing the position of the flange 34 and thereby the magnitude of the compression of the spring 32.

Considering now the function of the prior art knockout system as viewed in FIG. 2, it will be appreciated that the initial position of the knockout pin 20, as indicated by the plane 45, can be controlled or adjusted by the rotation of the rotatable housing 29 on the rear end 28 of the sleeve 26. As the housing is rotated so as to effect movement to the right, as viewed in FIG. 2, the plane of the forward end of the knockout pin 20 would be advanced to the right. As the housing 29 is rotated in the opposite direction on the sleeve 26, the push rod 25 and effective knockout pin position would be retarded to the left.

For adjustment of the spring bias of the central push rod and knockout pin 20, it will be appreciated that the adjusting nut 37 is rotated. Rotation of this nut adjusts the sleeve 33 in a forward direction (to the right) to relieve spring pressure, or in an opposite rearward direction to increase spring pressure. As the sleeve 33 moves in either direction, as indicated by arrow C, it will also be appreciated that it carries with it the central push rod 25. As this push rod is moved, the plane 45 of the initial position of the knockout pin is also moved in the same direction. Thus even after an initial position of the knockout pin is set, further adjustment of the spring pressure will cause that position to change, and further adjustment of the initial pin position is thereafter required.

It should also be appreciated in this particular prior device, as viewed in FIG. 2, that any change in the initial position of the knockout pin 20, by virtue of rotation of the housing 29 on the sleeve 26, will also cause an effective change in the spring bias exerted by the coil spring 32. For example, if the housing 29 is turned on the sleeve 26 so that the knockout pin is moved to the right, it will be appreciated that entire spring mechanism is carried along with the housing 29. Since in the extrusion process, the knockout pin is always forced rearwardly to the same end position by the pressure of the advancing mandrel and extruded aluminum material, the stroke of the knockout pin would be of greater magnitude when the pin is initially set to the right, than it would when the pin was initially set to the left (as viewed in FIG. 2). Since the stroke is thus greater for forward pin adjustments, the spring 32 would be collapsed more and thereby exert greater pressure during the forming process. Accordingly, when the knockout pin 20 is adjusted to a predetermined initial position, it is also necessary to readjust the preload position of the spring 32 to produce the desired spring bias and resulting desired diaphragm thickness. And to complicate matters, such readjustment of the preload in the spring 32 causes a further consequent change in the initial position of the knockout pin and so on. The final fine tuning of the prior art knockout system is thus complicated by the interdependency of the adjustment of the initial position of the knockout pin on the one hand, and the adjustment of the preload on the spring 32 on the other hand.

PREFERRED EMBODIMENT OF THE INVENTION

Turning now to FIG. 3, a preferred embodiment of applicant's invention will be explained in detail. As shown in FIG. 3, an improved knockout pin apparatus 50 is diagrammatically illustrated. This knockout pin apparatus 50 is preferably contemplated for use in a horizontal impact extrusion press as shown in FIG. 1 for making collapsible, closed-end aluminum tubes. Other uses and applications, however, will be appreciated. The apparatus 50 then, can be substituted for the apparatus 17 as shown in FIGS. 1 and 2.

In FIG. 3, a portion of the frame 51 of a horizontal impact extrusion press (not shown) is depicted. At the forward end of the frame 51, there is located a die structure 52, the details of which comprise no portion of this invention.

The die structure 52, however, generally includes a die holder 53, a pressure pad 54, and a die clamping nut 55. A die ring 56 is secured by the die clamping nut 55 and supports an annular carbide insert 57, having an internal diameter equal to the desired external diameter of the tube to be formed. The forming mandrel, of course, has an outside diameter slightly less than the internal diameter of the insert 57, one half the difference corresponding to desired tube wall thickness. Another die member 58 is shaped to the desired external dimensions of the forward end of the tube and includes an interior surface conforming to the desired neck and shoulder area of the to be formed tube.

When the knockout apparatus 50 is utilized to form collapsible aluminum tubes of the closed-end type, a slug S of aluminum, preferably of about 99.8% purity and of appropriate size, is automatically positioned at the mouth of the die as diagrammatically shown in FIG. 3. Thereafter, the mandrel 12 is urged to the left under substantial pressure to force the slug into the die and to extrude the aluminum material of the slug therein to form the neck, shoulder and tube walls of the tube. Significant pressure provided by the mandrel 12 causes the material of the slug to extrude into the die and form the neck and shoulder shapes, with excess material being extruded rearwardly around the mandrel to form the cylindrical tube walls.

The knockout pin apparatus 50 includes a knockout pin 60 abutting a knockout post 61. Preferably, knockout pin 60 and post 61 are operably disposed in abutting, but unconnected, relationship. The knockout post 61 is in turn secured to a central push rod 62. Central push rod 62 extends rearwardly, or to the left as viewed in FIG. 3, and is provided with a radial flange 63 and a threaded end 64. The rod is also provided with relieved areas 65 and 66 as shown for the purpose of friction reduction. If desired, the pin 60, post 61 and rod 62 could be integral.

The central push rod 62 reciprocates within a first support sleeve 67, mounted in the frame 51. The sleeve 67 includes a radial flange 68 secured against the frame 51 by means of a bolted collar or flange 69. The rearward end 70 of the sleeve 67 is externally threaded.

A rotatable housing 75 is threaded onto the rear end 70 of the sleeve 67 and is secured thereto by a housing lock nut 76. The housing 75 has an open interior and the rear end of the housing is internally threaded as at 77 for receipt of a high tension adjusting nut 78 therein. The high tension adjusting nut 78 is threaded in the rear end of the housing at 77. It will be appreciated that the pitch of the threads on the rear end 70 of the sleeve 67 is the same as the pitch between the rear end 77 of the housing 75 and the high tension adjusting nut 78 as will be described. A pressure pad or friction reducing 79 and spring seat 80 supported on a forward end of nut 78. The pressure pad 79 is preferably made from any suitable material. A high tension lock nut 81 is threaded onto the high tension adjusting nut 78 to lock the nut with respect to the housing 75.

A coil spring 83 is disposed in the housing 75 forwardly of nut 78 and spring seat 80 on which the rear end of spring 83 rests. It will be appreciated that the coil spring 83 is a heavy spring which may for example, be made from spring material having a cross sectional diameter of approximately $1\frac{1}{4}''$ for example, with the entire spring being about 9" or so in diameter, for use in making aluminum tubes of about $\frac{3}{4}''$ interior diameter.

At least one window 82, and preferably two or three windows, is provided in the housing wall 75. A scale (not shown) can be provided in the windows for the purpose of viewing the position of the spring seat 80 and therefore the amount of preload provided in the heavy coil spring 83 contained in housing 75.

A tension sleeve 85 is disposed within the housing 75 and has a forward flange 86 serving as a forward seat for the forward end of spring 83. The housing 75 is provided with a forward shoulder 87 and a circular annular sound dampening pad 88 is disposed on the shoulder 87. The flange 86 is biased by spring 83 into engagement with the pad 88, resting on shoulder 87, and defines a fixed position for the forward end of the spring 83 with respect to the housing 75.

The tension sleeve 85 extends rearwardly to a rear end 89. A low tension adjusting nut 90 is internally threaded and is screwed on to the threaded end 64 of the central push rod 62. A friction reducing pad 97 is disposed between nut 90 and the rear end of sleeve 85. A low tension lock nut is also threaded onto the end 64 to maintain the low tension adjusting nut 90 in position.

Three springs 92 (only one of which is shown in FIG. 3) are disposed in axially extending, radially spaced, bores extending forwardly in the flange 86. The forward ends of these springs are seated in the flange 63 which is integral with the central push rod 62. Also provided in the flanges 86 are a plurality of axially extending, radially spaced pins 93. The springs 92 constitute a relatively light spring loading or bias between the flanges 86 and 63 while the pins 93 maintain these two flanges from rotating with respect to each other.

When the low tension adjusting nut 90 is rotated to a position permitting a gap between the flanges 86 and 63, the springs 92 are collapsible when the knockout pin is moved rearwardly, in response to forming pressures until the flange 63 engages the flange 86. Thereafter, the central push rod is subjected to the bias of spring 83. The bias provided by springs 92 is insignificant with respect to the bias produced by spring 83.

After the mandrel 12 is withdrawn from the forming of a tube, the springs 92 serve to the push the knockout pin 60 in a forward direction, to the right as viewed in FIG. 3, to help in ejecting the tube from the die structure. It should be appreciated that this knockout assist structure does not comprise part of the invention.

Moreover, it should also be appreciated that the reference herein to the term "initial pin position", refers to the initial pin position upon effective engagement of the push rod 62 with spring 83. In a preferred set up mode, the low tension adjusting nut 90 can be rotated until the flange 63 is in abutting contact with the flange 86. If knockout assistance is desired, the gap between the flanges 63, 86 is adjusted after initial pin position and spring preload has been set. Such gap adjustment is independent of both such parameters.

At the rear or left hand end of the apparatus of FIG. 3, cover 94 is threaded into the rear end of the high tension adjusting nut 78.

Finally, it will be appreciated that the knockout pin 60 has a forward end 95 disposed in a plane diagrammatically shown at 96 and comprising a predetermined initial pin position.

OPERATION OF PREFERRED EMBODIMENT

As stated above, the location of the initial pin position, i.e. the position of the plane 96, is critical in the formation of collapsible aluminum tubes. Advancement of the forward end 95 of knockout pin 60 too far into the die, or to the right, may cause a piercing of any membrane to be formed in the closed end of the tube. On the other hand, if the pin is retarded or moved to the left, as viewed in FIG. 3, beyond the proper position, a cold weld is formed in the aluminum surface comprising the interior neck of the to be formed tube. This cold weld advances to the right, or into the tube, the further the initial pin position is withdrawn. Such cold weld can result in further surface deformations upon the rolling of threads or the like into the neck of the tube. These deformations can cause the aluminum material to sliver off so that they are conveyed in any compound ejected from the eventually filled tube. This is highly undesirable. Accordingly, it is necessary to secure the proper initial pin position at the proper plane 96 in order, on the one hand, to prevent piercing or blanking out of the tube, and on the other hand to prevent the formation of a cold weld in the interior neck of the tube.

An initial pin position is selected according to experience with the equipment. Generally, the proper pin position is that predetermined position of the pin with respect to the die when the pin, knockout post and push rod are just beginning to be influenced by spring 83 upon further rearward movement.

According to the invention, and to the apparatus as shown in FIG. 3, the desired initial pin position is attained by rotation of the body 75 on the rear end 70 of the sleeve 67. This can be accomplished by loosening of the housing lock nut 76 and the rotation of the housing 75 in the proper direction. Rotation of housing 75 on the sleeve 67 causes the advancement or retraction of the central push rod 62, and thereof the effective position of the knockout pin 60. Once the appropriate position of the forward end 95 of the knockout pin 60 is selected and set, the lock nut 76 is secured against the housing 75 to retain that position, easily within ±0.010".

Thereafter, the preload on the spring 83 is adjusted by loosening of the high tension lock nut 81 and the rotation of the high tension adjusting nut 78. Since the pitch of the threads on the sleeve 67 on which the rotatable housing 75 is mounted is the same as the pitch of the threads of high tension lock nut 78 in the housing, it is only necessary to rotate the high tension lock nut through the same angular rotation, and in the proper direction, as the housing 75 was moved on the sleeve 67 to re-establish any predetermined spring preload which was set before the adjustment of the pin position.

For example, if the pin position is advanced by a movement of housing 75 to the right, the final pin stroke will be longer. In order to achieve the same effective pressure over this new stroke length, the spring preload must be decreased by proper rotation of high tension adjusting nut 78. In the alternative, the high tension adjusting nut 78 is simply turned to set a predetermined known preload into the coil spring 83. The amount of preload on the spring 83 can be viewed through the window 82 in which a scale (not shown) can be mounted, and against which movement of spring seat 80 can be measured.

It will be appreciated that there is a significant difference in the knockout pin apparatus 50, as shown in FIG. 3, and the prior art device 17. In particular, in the improved knockout pin apparatus 50, the preload of the spring 83 is adjusted by moving its rearward (or left-hand) end toward or away from the forward spring end and shoulder 87 in the housing 75. The forward end of the spring against which the rod 62 reacts, remains fixed with respect to the housing. In the prior system 17, the forward end of the spring 32 is moved when this adjustment is made. Since the push rods of both devices are operably connected with the forward end of these springs, preload adjustment of spring 83 in the preferred embodiment 50 does not cause movement of rod 62, while preload adjustment of spring 32 in prior device 17 does cause such movement.

Accordingly, the adjustment of the spring 83 does not result in any change in the initial position of the push rod 62 or of the knockout pin 60, nor does it require any further adjustment to the pin position as does the prior apparatus shown in FIG. 2.

When setting up an impact extrusion operation utilizing the knockout pin apparatus 50 of applicant's invention, it is only necessary to determine the desired initial pin position (plane 96). The rotatable housing 75 is then adjusted on the sleeve 67 to attain this particular position, and the housing is thereafter locked and need not be changed or adjusted again. Thereafter, the spring preload, that is of spring 83, is set independently of the position of the knockout pin 60 and without changing or effecting that position.

It will also be appreciated that the pads or members 79 and 88 serve to reduce noise as the components of the apparatus are reciprocated in an extrusion process.

Moreover, it will be appreciated that if knockout assist is required, the low tension adjusting nut 90 will be rotated on the push rod 62 to adjust the gap between the flanges 86 and 63. Where there is such a gap, the relatively low bias in the springs 92 is not so relatively significant as to change the effective forward bias on the knockout pin 60 which is provided in major part by the heavy coil spring 83. Such bias, of course, provides for adjustment of the desired thickness of the membrane or diaphragm in the closed-end tube, with heavier preloads producing a reduced membrane thickness and lighter preloads resulting in a thicker membrane thickness.

Accordingly, the set up of the knockout system in an impact extrusion press is greatly facilitated. The pin position can be set without regard to the spring pressure or preload which is thereafter set independently of the pin position, without changing the pin position and without requiring a further pin position adjustment.

It should be appreciated that while the knockout pin apparatus of the invention has numerous applications, one particularly useful application is in a high speed impact extrusion press operating at about 140 or more strokes per minute. Of course, the knockout pin apparatus of the invention can be used in lower speed impact extrusion operations as well.

These and other advantages and modifications will be become readily apparent to those skilled in the art without departing from the scope of this invention and the applicant intends to be bound only by the claims appended hereto.

We claim:

1. An improved knockout pin apparatus for an impact extrusion press and including:

a knockout pin operatively associated with a push rod, a first sleeve mounted on said press and having a threaded rear end, said push rod extending therethrough, a rotatable housing threaded on said first sleeve, a shoulder defined in said housing, a tension sleeve in said housing having a radial flange, a spring means about said tension sleeve and supported at one end on said flange, said flange supported by said shoulder, a spring adjusting nut mounted in said housing at another end of said spring for compressing said spring toward said flange and shoulder and thereby adjusting preload of said spring thereagainst, and said flange operably connected to said push rod, wherein said spring preload is adjustable independently of the position of said push rod and knockout pin.

2. Apparatus as in claim 1 further including shock absorbing means between said flange and said shoulder.

3. Apparatus as in claim 1 further including a window in said housing in viewing register with a rearward end of said spring proximate said spring adjusting nut.

4. Apparatus as in claim 1 wherein the thread pitch of said first sleeve is the same as the thread pitch of said spring adjusting nut whereby changes in effective spring preload caused by adjustment in pin position by rotation of said housing on said first sleeve can be compensated by like angular adjustment, in a proper direction, of said spring adjustment nut with respect to said housing to maintain a predetermined effective preload.

5. Apparatus as in claim 1 wherein said knockout pin is disposed in an initial position within said press, said housing is rotatable on said first sleeve to vary said initial pin position, and wherein said spring preload is adjustable independently of said initial pin position.

* * * * *